US007017260B2

(12) United States Patent
Weiss et al.

(10) Patent No.: US 7,017,260 B2
(45) Date of Patent: Mar. 28, 2006

(54) METHOD OF MAKING AN ELASTOMERIC CONDUCTIVE SHEET

(76) Inventors: Roger E. Weiss, 10 Mary Way, Foxboro, MA (US) 02035; Christopher Cornell, 463 Rock O'Dundee Rd., South Dartmouth, MA (US) 02748; Matthew McCarthy, 15 Roseway, Taunton, MA (US) 02780

( * ) Notice: Subject to any disclaimer, the term of this patent is extended or adjusted under 35 U.S.C. 154(b) by 207 days.

(21) Appl. No.: 10/338,804

(22) Filed: Jan. 8, 2003

(65) Prior Publication Data

US 2004/0251572 A1 Dec. 16, 2004

Related U.S. Application Data

(60) Provisional application No. 60/346,820, filed on Jan. 8, 2002.

(51) Int. Cl.
*H01R 43/00* (2006.01)

(52) U.S. Cl. ..... 29/825; 29/830; 29/832; 29/833; 439/91

(58) Field of Classification Search ..... 29/825, 29/830, 832, 833; 439/91
See application file for complete search history.

(56) References Cited

U.S. PATENT DOCUMENTS 4,778,950 A * 10/1988 Lee et al. ..... 174/35 GC
5,101,553 A * 4/1992 Carey et al. ..... 29/882
5,851,644 A * 12/1998 McArdle et al. ..... 428/213
6,497,583 B1 * 12/2002 Weiss et al. ..... 439/91
6,802,720 B1 * 10/2004 Weiss et al. ..... 439/66

* cited by examiner

*Primary Examiner*—Carl J. Arbes
(74) *Attorney, Agent, or Firm*—Brian M. Dingman

(57) ABSTRACT

Devices and methods of stressing anisotropic conductive elastomer (ACE) sheet material that defines a plurality of electrical pathways through its thickness. The perimeter of the sheet is mechanically gripped, while leaving an interior portion of the sheet free. A surface over which the interior portion of the sheet is to be stretched is provided, and the sheet and the surface are contacted. The sheet and the surface are then relatively moved, to stretch the sheet over the surface, and thereby stress the interior portion of the sheet.

9 Claims, 6 Drawing Sheets

METHOD OF MAKING AN ELASTOMERIC CONDUCTIVE SHEET

CROSS REFERENCE TO RELATED APPLICATION

This application claims priority of Provisional application Ser. No. 60/346,820, filed on Jan. 8, 2002.

FIELD OF THE INVENTION

This invention relates to the pre-stressing of elastomer-based conductive materials for electrical connectors.

BACKGROUND OF THE INVENTION

Anisotropic Conductive Elastomer (ACE) is a composite of conductive metal particles in an elastomeric matrix. ACE is normally constructed such that it conducts along one axis only. Usually, ACE is a sheet that is made to conduct through its thickness. In one reduction to practice, ACE achieves its anisotropic conductivity by mixing magnetic particles with a liquid resin, forming the mix into a continuous sheet, and curing the sheet in the presence of a magnetic field. This results in the particles forming columns through the sheet thickness. The columns are electrically conductive. The resulting structure has the unique property of being flexible and anisotropically conductive. When a layer of ACE is compressed between two electrical conductors, the particles in the compressed column come into contact with each other and the conductors, forming an electrically conductive path.

As devices using ACE warm up, the elastomeric material thermally expands at a higher rate than the metal, ceramic and other components of the system. The lateral expansion of the elastomer disrupts the particle column integrity, and the vertical expansion tends to unload the columns, which expand at a much lower rate. Both of these effects impact on the electrical stability of the interconnect with temperature. It has been shown that the electrical instability caused by the differential thermal expansion of the elastomer can be eliminated by pre-stressing (stretching) the sheet to a level beyond that provided by the expansion of the elastomer over the operational thermal range. As a stretched sheet of elastomer is heated, it will relax with temperature but not physically move laterally until all the stress is gone. Hence no disruptive motion of the columns will occur over the system thermal operating range when sufficient stretch has been applied. Furthermore, as the sheet is stretched, the height of the columns does not change but rather the elastomer between the columns necks down to provide the material for the increased area of the stretched sheet. This necking provides the additional free volume needed by the system to offset the vertical expansion of the elastomer with temperature in a direction parallel to the columns.

SUMMARY OF THE INVENTION

It is therefore an object of this invention to provide several devices and methods for pre-stressing (stretching) ACE material.

It is a further object of this invention to provide such methods and devices that capture pre-stressed ACE material and maintain the material in this state for use as an electrical connective medium.

It is a further object of this invention to provide methods and devices that maintain ACE in a state in which it is more electrically stable over a wider operating temperature range.

This invention features in one embodiment a method of stressing anisotropic conductive elastomer (ACE) sheet material that defines a plurality of electrical pathways through its thickness, the sheet defining a perimeter, the method comprising mechanically gripping the sheet perimeter, while leaving an interior portion of the sheet free, providing a surface over which the interior portion of the sheet is to be stretched, contacting the sheet and the surface, and relatively moving the sheet and the surface, to stretch the sheet over the surface, and thereby stress the interior portion of the sheet.

The method may further comprise, while the sheet is stretched, fixing at least one frame structure to the stretched sheet, such that stretched ACE materials spans the frame opening, and then removing from the sheet the frame with the spanning ACE material. The frame may define means for aligning the frame with a printed circuit board. The means for aligning may comprise spaced holes through the frame, adapted to fit therethrough mechanical structures that engage with the printed circuit board.

The mechanically gripping step may comprise clamping the sheet perimeter. The sheet perimeter may be square, and the entire sheet perimeter may be clamped. The free interior portion of the sheet may be square. There is preferably an even gap between the sheet perimeter clamp and the surface when the sheet contacts the surface.

Also featured is an apparatus for stressing anisotropic conductive elastomer (ACE) sheet material that defines a plurality of electrical pathways through its thickness, the sheet defining a perimeter, the apparatus comprising a perimeter clamp for clamping the entire sheet perimeter, while leaving an interior portion of the sheet free, a table over which the interior portion of the sheet is to be stretched, and mechanical structure that allows the clamp and the table to move relative to one another, to stretch the sheet over the table, and thereby stress the interior portion of the sheet.

The clamp interior perimeter preferably define the same shape as the table exterior perimeter, to create an even gap between the clamp and the table when the sheet first contacts the table, to evenly stretch the sheet.

Also featured is a method of stressing anisotropic conductive elastomer (ACE) sheet material that defines a plurality of electrical pathways through its thickness, the method comprising providing a frame that defines a plurality of spaced projections around its perimeter, creating a plurality of holes through the sheet of ACE in a defined pattern having a predetermined relationship to the frame projections, and stretching the sheet and fitting the holes over the projections, to maintain the sheet in tension on the frame.

Further featured in the invention is a method of stressing anisotropic conductive elastomer (ACE) sheet material that defines a plurality of electrical pathways through its thickness, the method comprising providing an array of spaced pins arranged to rotate about a center but that are radially fixed, creating a plurality of holes through the sheet of ACE in a defined pattern having a predetermined relationship to the array of pins, mounting the sheet to the pins by fitting the holes over the pins, and rotating the pins outward from the center, to thereby stretch the sheet and maintain the sheet in tension on the pins.

BRIEF DESCRIPTION OF THE DRAWINGS

Other objects, features and advantages will occur to those skilled in the art from the following description of the preferred embodiments and the accompanying drawings in which.

DESCRIPTION OF THE PREFERRED EMBODIMENTS OF THE INVENTION

Figure 1:
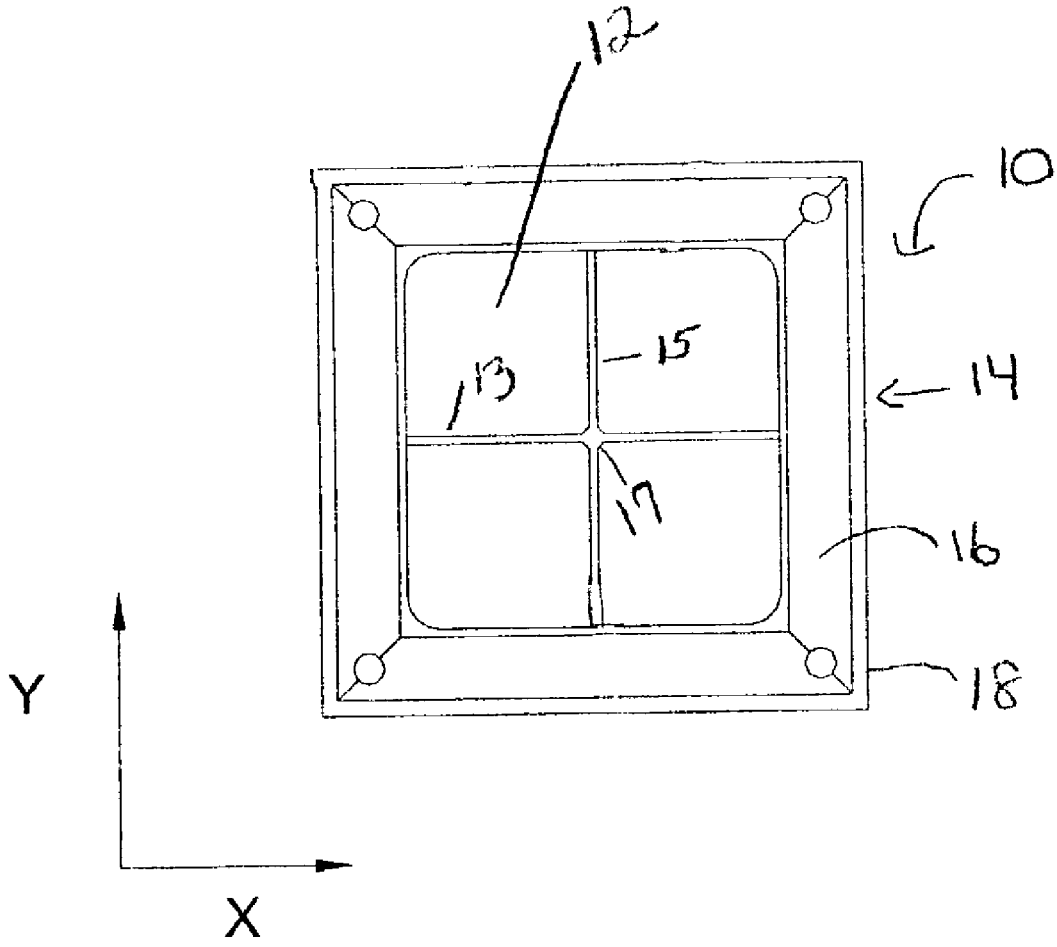
FIG. 1 is a top view of one preferred embodiment of a device of this invention that is also useful in practicing a method of this invention.
Figure 2:
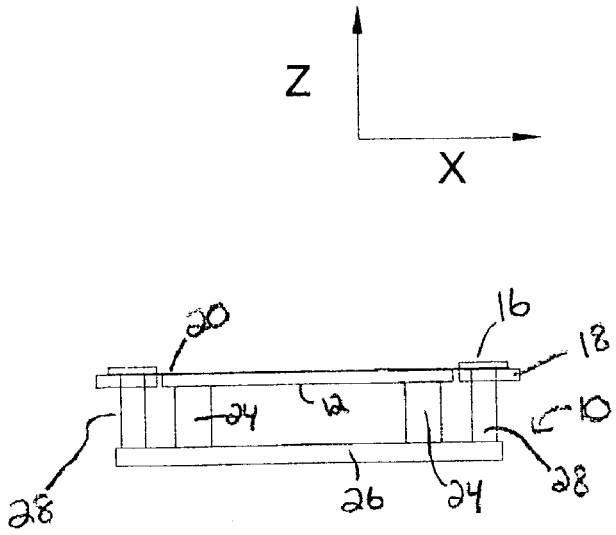
FIG. 2 is a side view of the device of FIG. 1 with a sheet of ACE material loaded in the device before the ACE is stretched.
Figure 3:
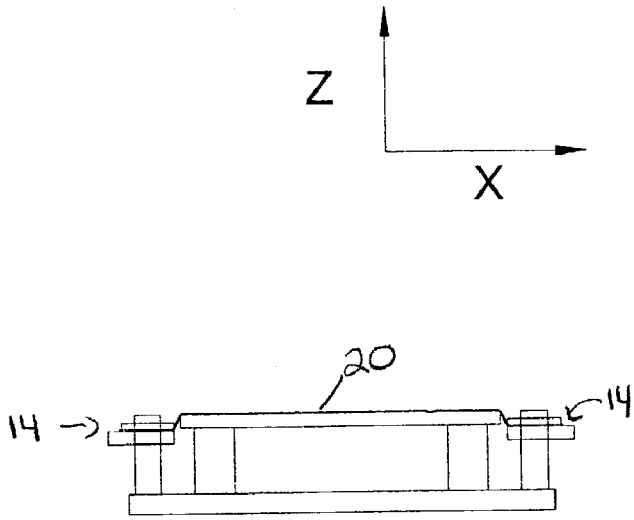
FIG. 3 is a similar view but with the device in operation stretching the ACE.

One embodiment of a device of this invention that can also be used to practice a method of this invention, is shown in FIGS. 1–3. Device 10 according to this invention comprises fixed table 12 and moveable ACE material clamp 14. The concept of this embodiment is to grasp a sheet of ACE material around preferably all of its perimeter portion, and provide a flat surface over which the ACE is to be stretched. The frame and surface are then placed so that the free portion of the ACE material bounded by the frame is contacted by the table. The frame and table are then moved relative to one another to stretch the ACE over the table. The stretched portion of the ACE material can then be captured in one or more use devices, such as frame structures that are bonded to the stressed ACE. The ACE can then be cut to remove the frame from the sheet. This leaves a portion of pre-stressed ACE material mounted onto a frame structure. The frame structure with ACE can then be used as a flexible electrical interconnect that is mechanically separable and reusable. The stretched ACE material provides increased electrical stability at a wider operating temperature as compared to un-stressed ACE material.

In the embodiment of FIGS. 1–3, a sheet of ACE material 20 is placed on table 12 and on lower portion 18 of clamp 14. Upper portion 16 of clamp 14 is then placed over the perimeter portion of ACE material 20 and fixed to clamp portion 18 by some means such as pins, or locking devices (not shown in the drawing). Table 12 is supported on legs 24 and base 26, which also supports mechanical structure 28 (e.g., guide pins) that maintains a fixed lateral relationship between table 12 and clamp 14. FIG. 2 depicts device 10 ready to be used with the ACE material clamped around its perimeter and in contact with table 12. Since table 12 and frame 14 are both square, there is an essentially even gap between the interior of frame 14 and the exterior of table 12. The ACE material is thus uniformly stretched from the material center (center 17 of square table 12) as frame 14 is moved down in relation to table 12, to the lowest or end position shown in FIG. 3. Frame 14 is then held in this position by a mechanical means, not shown in the drawings.

Figure 10:
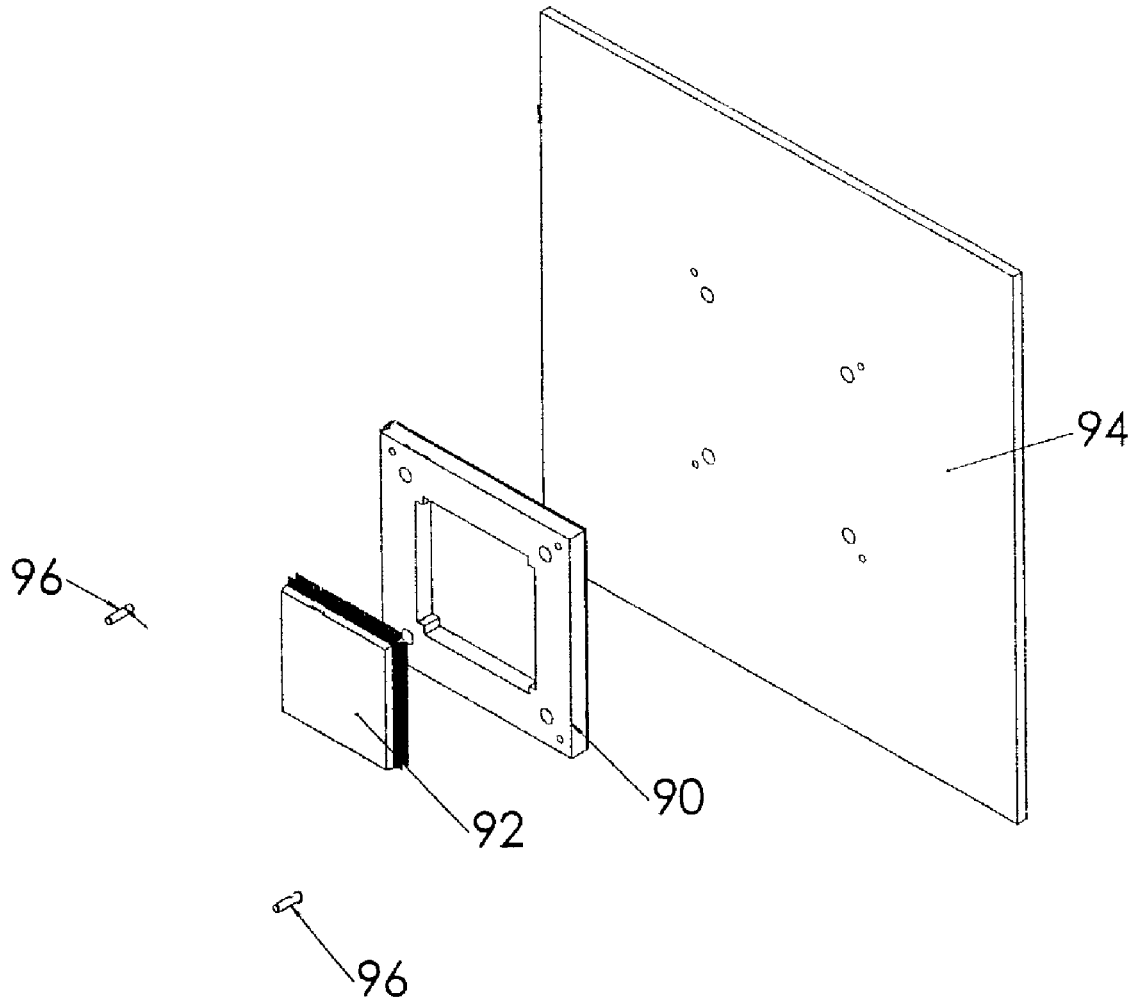
FIG. 10 is an exploded schematic view of one use for the stretched ACE material stretched by one or more of the devices and methods of this invention.

The stretched ACE material can then be captured in a use device, such as frame 90, FIG. 10, for use as an electrical connector. This will be explained in more detail below. Note that it is not necessary that the starting ACE sheet be square or that its entire perimeter be gripped. A device capturing the concept of that shown in FIGS. 1–3 could be designed with other shapes to achieve other stretching objectives. In most cases, however, uniform stress is desired.

In order to both reduce binding of the ACE as it is stretched using device 10, and to help release the stretched ACE material from table 12, one or more grooves in the top of table 12 such as grooves 13 and 15 can be placed into the upper surface of table 12. These grooves are designed to allow compressed air to be blown through the groove and spread over the tabletop to help release the ACE material from the tabletop and prevent it from binding while it is being stretched. Once the material is in the completed state a small amount of compressed air can be passed through the release grooves. This step will cause a small wave to flow through the material and remove any localized sticking between the table and material.

Once the ACE is stretched, a rigid frame is bonded by mechanical or adhesive means to the active area of the stretched sheet. It should be noted that the size of the stretch table and sheet can be so as to accommodate one or several rigid frames. Once the rigid frame(s) are bonded to the coupon, the rigid frame and associated ACE can be removed from the sheet (for example by cutting), with the tension in the ACE being maintained by the rigid frame.

Two additional methods and devices for stretching of ACE material, a fixed stretch frame and a variable stretch frame, are also within the scope of the invention. Other methods and apparatus, based on this disclosure, will become obvious to those skilled in the art.

Figure 4:
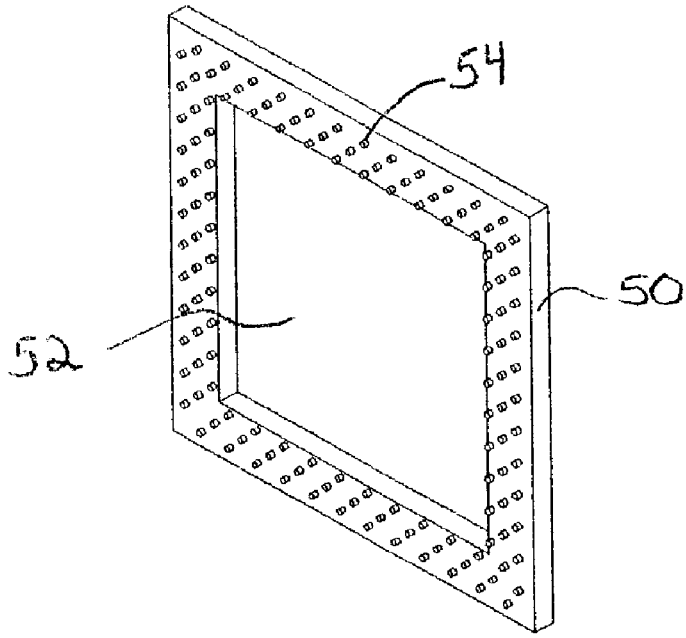
FIG. 4 is an axonometric view of an ACE-stretch frame according to another embodiment of this invention.
Figure 5:
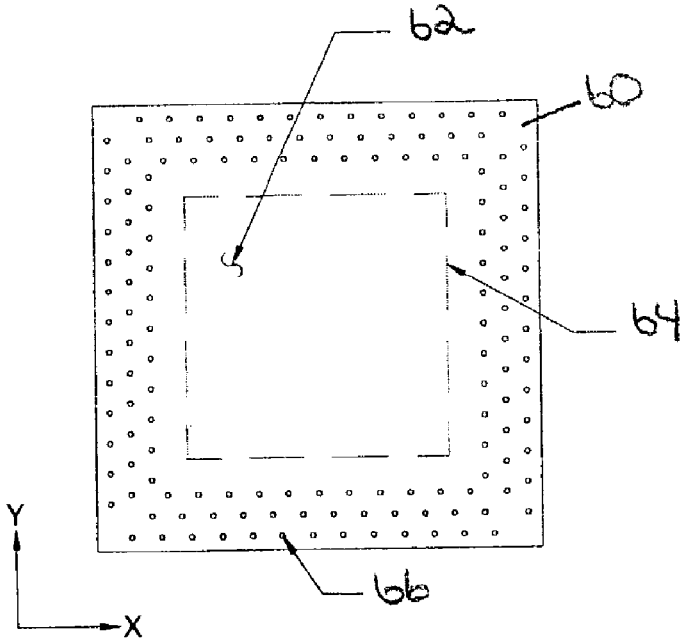
FIG. 5 is a top view of a sheet of ACE material with holes placed through its thickness to match the pattern of the pins of the frame of FIG. 4.

FIG. 4 shows a mounting frame 50 with an array of pins 54 onto which a sheet of ACE to be stretched is mounted. The frame defines central open area 52. FIG. 5 shows a sheet of ACE material 60 prior to fitting it on fixed stretch frame 50. Sheet 60 has an array of punched holes 66 formed at the periphery in a defined pattern. The relationship between the holes in the sheet and the pins on the frame is such that sheet 60 is placed in uniform, radial tension when it is mounted on frame 50. The relationship between the pins and holes is established to develop the desired tension in the sheet. The useable area 62 of the sheet, which is under tension, is indicated by dashed line 64.

Figure 6:
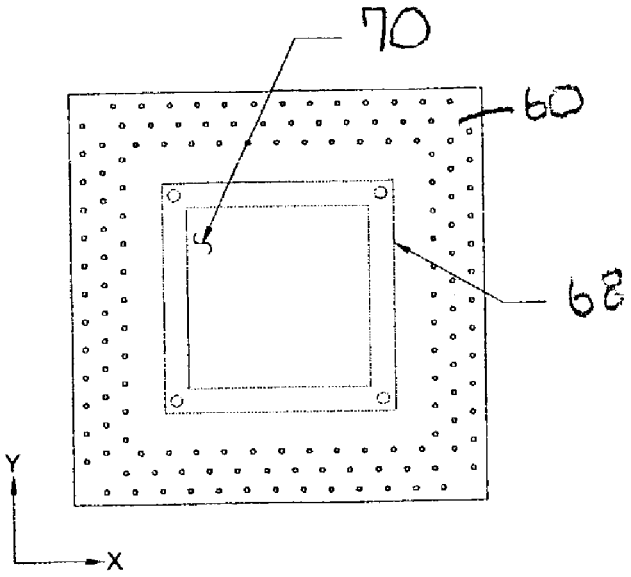
FIG. 6 is a similar view of ACE material from FIG. 5 but stretched in place over the frame of FIG. 4 and with a stressed-ACE material capturing frame structure placed thereon.

Once the sheet has been stretched, a rigid frame is bonded by mechanical or adhesive means to the active (stretched and hole-free) area of the sheet. It should be noted that the sizes of the sheet and the stretch frame can be designed so as to accommodate one, or more than one, rigid frames. Once the rigid frames are bonded to the sheet, the rigid frame and associated ACE can be removed from the sheet, with the tension in the ACE being maintained by the rigid frame. FIG. 6 shows a single rigid frame 68 bonded to the stretched sheet 60 prior to its removal from the sheet.

FIGS. 4–6 are for an apparatus and method which provides a fixed, uniform stretch to the ACE. The following description demonstrates an apparatus and method used to apply a variable level of uniform stretch to ACE material.

Figure 8:
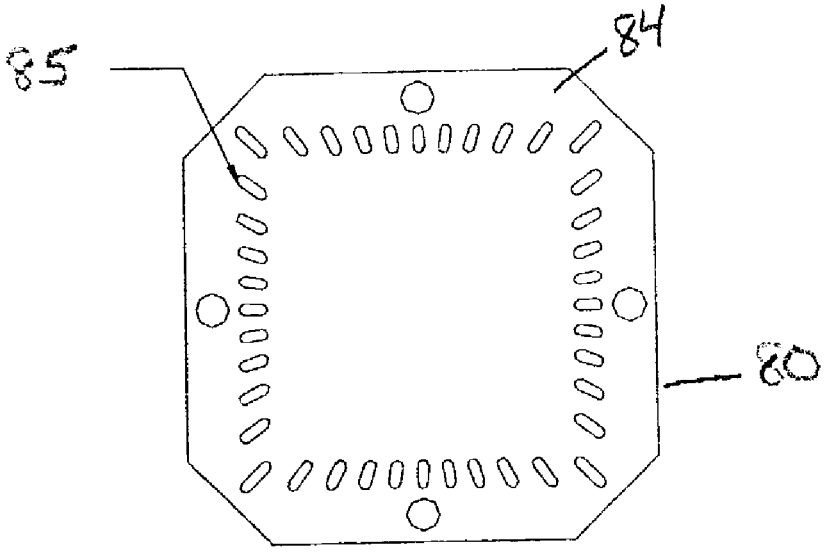
FIG. 8 is a top view of the top actuator plate of the device of FIG. 7.
Figure 7:
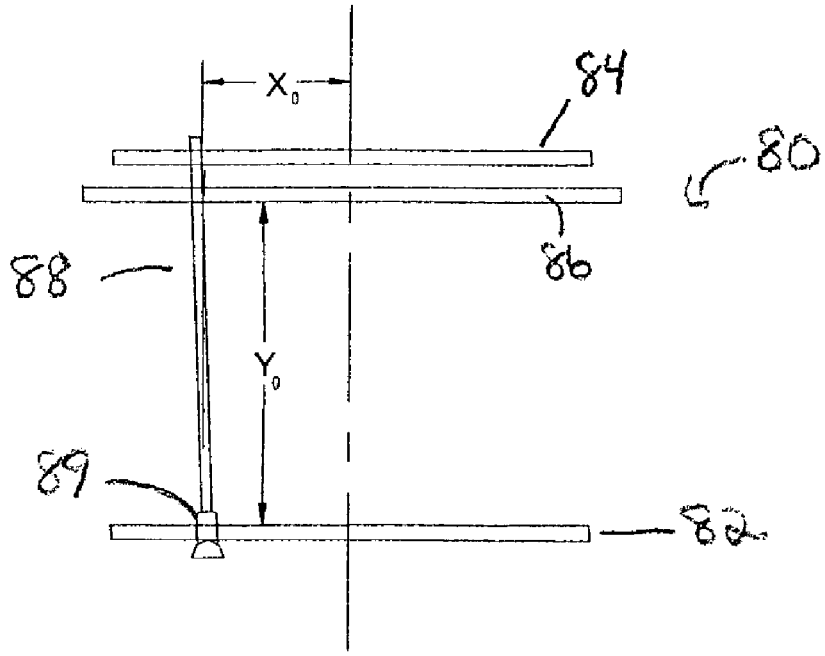
FIG. 7 is a side view of another device of this invention, also for use in performing another method of this invention.
Figure 9:
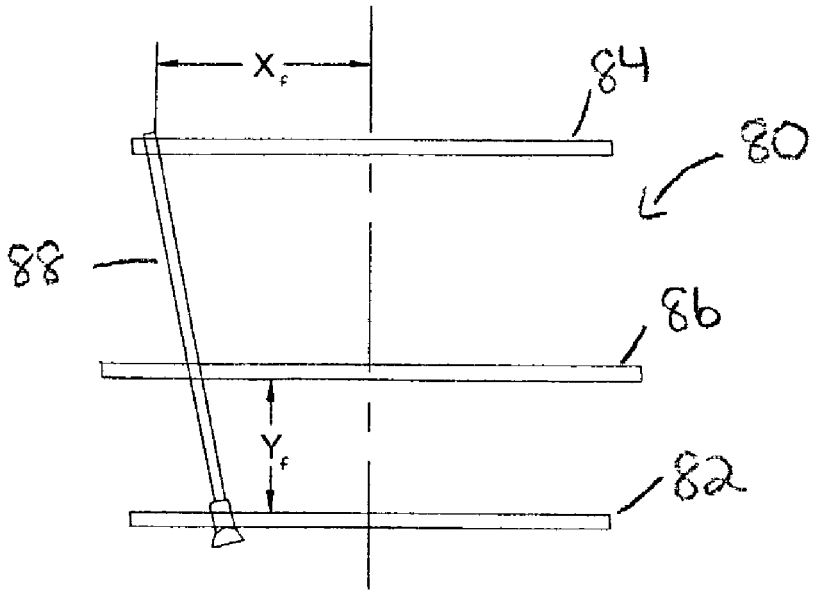
FIG. 9 is a view similar to that of FIG. 7 but showing the device in the use position in which the ACE material is fully stretched.

FIG. 8 is a top view of a variable stretch frame fixture 80 of this invention. The slots 85 are guides that let actuator pins move radially. This approach gives continuous uniform radial stretch to the ACE coupon. FIGS. 7 and 8 show a side view of fixture 80 in the initial and stretched positions, respectively. The space between the top 84 and bottom 82 plates is fixed by spacer rods (not shown). The sliding actuator plate 86 is free to move between the top and bottom plate, but is confined to stay parallel to the top plate. An array of pins 88 (only one shown) are pivotally mounted at 89 to bottom plate 82, so that each pin can rotate to and from the system center, but is radially fixed at the bottom plate. The pins are slightly canted out as shown in FIG. 8. These pins pass through strategically placed holes in the actuator plate 86. As the actuator plate is lowered from its top position to its bottom position, the pins are driven radially outwardly by the actuator plate, from the inner end of the slot 85 in the top plate 84, toward the outer end of the slot. A sheet of ACE is mounted on the pins on plate 84. As the pins move radially outward from the center, the ACE is variably stretched based on the position of the actuator plate. A direct relationship between the degree of stretch and the position of the sliding actuator plate can be determined.

As with the fixed stretch frame, a pre-punched sheet of ACE (not shown) is mounted to the pins. This is done with the actuator plate at the top position, allowing the sheet to be attached with little or no tension. The actuator plate is then lowered, uniformly stretching the sheet. Rigid frames are then bonded to the sheet as described above.

FIG. 10 shows one use of pre-stressed ACE of this invention. Alignment frame 90 with stretched ACE attached is used to electrically connect the electronic device 92 to the printed circuit board 94. Alignment of the electronic device is accomplished by the internal cutout of the alignment frame, or other features (not shown), and transferred to the printed circuit board via the alignment pins 96 that pass through openings in frame 90 and into openings in board 94.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A method of stressing anisotropic conductive elastomer (ACE) sheet material that defines a plurality of electrical pathways through its thickness, the sheet defining a perimeter, the method comprising:

mechanically gripping the sheet perimeter, while leaving an interior portion of the sheet free;

providing a surface over which the interior portion of the sheet is to be stretched;

contacting the sheet and the surface; and relatively moving the sheet and the surface, to stretch the sheet over the surface, and thereby stress the interior portion of the sheet.

2. The method of claim 1, further comprising, while the sheet is stretched, fixing at least one frame structure to the stretched sheet, such that stretched ACE materials spans the frame opening, and then removing from the sheet the frame with the spanning ACE material.

3. The method of claim 2 wherein the frame defines means for aligning the frame with a printed circuit board.

4. The method of claim 3 wherein the means for aligning comprises spaced holes through the frame, adapted to fit therethrough mechanical structures that engage with the printed circuit board.

5. The method of claim 1 wherein the mechanically gripping step comprises clamping the sheet perimeter.

6. The method of claim 5 wherein the sheet perimeter is square.

7. The method of claim 5 wherein the entire sheet perimeter is clamped.

8. The method of claim 7 wherein the free interior portion of the sheet is square.

9. The method of claim 5 wherein there is an even gap between the sheet perimeter clamp and the surface when the sheet contacts the surface.

* * * * *